US008161982B2

(12) United States Patent
Hsu

(10) Patent No.: US 8,161,982 B2
(45) Date of Patent: Apr. 24, 2012

(54) HAIR ORNAMENT

(76) Inventor: Shih Ling Hsu, Tainan (TW)

( * ) Notice: Subject to any disclaimer, the term of this patent is extended or adjusted under 35 U.S.C. 154(b) by 184 days.

(21) Appl. No.: 12/793,053

(22) Filed: Jun. 3, 2010

(65) Prior Publication Data

US 2011/0297178 A1 Dec. 8, 2011

(51) Int. Cl.
*A45D 8/20* (2006.01)

(52) U.S. Cl. ..... 132/277; 24/489; 24/499; 24/DIG. 22

(58) Field of Classification Search ..... 132/273, 132/277, 278
See application file for complete search history.

(56) References Cited

U.S. PATENT DOCUMENTS 6,325,073 B1 * 12/2001 Di Maria Poole et al. .... 132/275
* cited by examiner

*Primary Examiner* — Rachel Steitz

(57) ABSTRACT

A hair ornament includes a body having an engagement section to be in contact with hair of a user. The engagement section includes a row of plates arranged along a length direction of the body. Two of the row of plates adjacent to each other are connected by a connecting member having first and second ends. The first end of each connecting member is pivotably connected to one of two adjacent plates. The second end of each connecting member is pivotably connected to the other of the two adjacent plates. A spacing between two adjacent plates is adjustable by pivoting the two adjacent plates to adjust an overall length of the body in the length direction of the body.

6 Claims, 13 Drawing Sheets

HAIR ORNAMENT

BACKGROUND OF THE INVENTION

1. Field of the Invention

The present invention relates to a hair ornament and, more particularly, to a hair ornament that has an adjustable contact area with the hair of the user.

2. Description of the Related Art

Conventional hair ornaments have various types and have an engagement section for contact with the hair of the user. The engagement section generally includes a couple of plates that can be in contact with the hair by extending through or clamping the hair, allowing the hair ornament to be positioned on the hair.

FIG. 14 shows a conventional hair ornament including a body 1' having two symmetric clamping portions 11' each having an engagement section 111' at a lower end thereof. The engagement section 111' includes a plurality of teeth or plates 112' at a bottom end thereof. The clamping portions 11' are pivoted together. A spring 12' is attached between the clamping portions 11' to bias the clamping portions 11' to a position clamping the hair. The plates 12' are extended through the hair to prevent the body 1' from falling from the hair. However, an overall width A of the engagement sections 111' of the clamping portions 11' and the extending area of the plates 112' in the hair are fixed. Namely, the hair ornament can not be adjusted according to differing head sizes and differing hair amounts of different users.

Thus, a need exists for an adjustable hair ornament that can be adjusted according to differing head sizes and differing hair amounts of different users.

BRIEF SUMMARY OF THE INVENTION

The present invention solves this need and other problems in the field of adjustable hair ornaments by providing, in a preferred form, a hair ornament including a body having an engagement section adapted to be in contact with hair of a user. The engagement section includes a row of plates arranged along a length direction of the body. Two of the row of plates adjacent to each other are connected by a connecting member having first and second ends. The first end of each connecting member is pivotably connected to one of two adjacent plates. The second end of each connecting member is pivotably connected to the other of the two adjacent plates. A spacing between two adjacent plates is adjustable by pivoting the two adjacent plates to adjust an overall length of the body in the length direction of the body.

In a preferred form, the body includes first and second clamping portions that are pivoted together. An elastic element is mounted between the first and second clamping portions. Each of the first and second clamping portions includes a pressing portion on an end thereof. Each of the first and second clamping portions includes the engagement section. Each plate includes first and second pivotal portions. The first and second ends of each connecting member include third and fourth pivotal portions. The first and second pivotal portions are one of a pin and a hole. The third and fourth pivotal portions are the other of the pin and the hole. The third pivotal portion of each connecting member is pivotably engaged with the first pivotal portion of one of two adjacent plates. The fourth pivotal portion of each connecting member is pivotably engaged with the second pivotal portion of the other of the two adjacent plates. The pressing portions are provided at centers of the first and second clamping portions. An extension extends from each of two opposite sides of each of the first and second pressing portions. Each extension includes a guide slot extending in the length direction and slideably receiving one of the first and second pivotal portions of at least one of the plates.

In another preferred form, the body includes first and second clamping portions pivoted together at first ends thereof. Each of the first and second clamping portions includes an engaging portion on a second end thereof. Each of the first and second clamping portions further includes the engagement section intermediate the first and second ends. The first and second clamping portions are openable to receive the hair of the user. The engaging portions are releasably engaged with each other such that the engagement section of each of the first and second clamping portions clamps the hair of the user. Each plate includes first and second pivotal portions. The first and second ends of each connecting member include third and fourth pivotal portions. The first and second pivotal portions are one of a pin and a hole. The third and fourth pivotal portions are the other of the pin and the hole. The third pivotal portion of each connecting member is pivotably engaged with the first pivotal portion of one of two adjacent plates. The fourth pivotal portion of each connecting member is pivotably engaged with the second pivotal portion of the other of the two adjacent plates. The first end of each of the first and second clamping portions includes first and second extensions spaced in a direction perpendicular to the length direction. Each engaging portion includes third and fourth extensions spaced in the direction perpendicular to the length direction. The engagement section of the first clamping portion is mounted between the first and third extensions. The engagement section of the second clamping portion is mounted between the second and fourth extensions. Each of the first, second, third, and fourth extensions includes a guide slot extending in the length direction and slideably receiving one of the first and second pivotal portions of at least one of the plates.

In a further preferred form, the body includes first and second gripping portions. The engagement section is intermediate the first and second gripping portions. Each of the plates includes first and second pivotal portions. The first and second ends of each connecting member include third and fourth pivotal portions. The first and second pivotal portions are one of a pin and a hole. The third and fourth pivotal portions are the other of the pin and the hole. The third pivotal portion of each connecting member is pivotably engaged with the first pivotal portion of one of two adjacent plates. The fourth pivotal portion of each connecting member is pivotably engaged with the second pivotal portion of the other of the two adjacent plates. Each of the first and second gripping portions includes first and second extensions spaced in a direction perpendicular to the length direction. Each of the first and second extensions includes a guide slot extending in the length direction and slideably receiving one of the first and second pivotal portions of at least one of the plates.

In another preferred form, the body includes first and second two clamping plates pivotably connected to each other. The first and second clamping plates are openable to receive the hair of the user. The hair of the user is clamped by the first and second clamping plates when the first and second clamping portions are pivoted to a clamping position. The second clamping plate includes the engagement section. Each plate includes first and second pivotal portions. The first and second ends of each connecting member include third and fourth pivotal portions. The first and second pivotal portions are one of a pin and a hole. The third and fourth pivotal portions are the other of the pin and the hole. The third pivotal portion of each connecting member is pivotably engaged with the first pivotal portion of one of two adjacent plates. The fourth pivotal portion of each connecting member is pivotably engaged with the second pivotal portion of the other of the two adjacent plates. The second clamping plate includes first and second ends. The first end of the second clamping plate is pivotably connected to the first clamping plate. Each of the first and second ends of the second clamping plate includes an extension having a guide slot. Each guide slot extends in the length direction and slideably receives one of the first and second pivotal portions of at least one of the plates.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
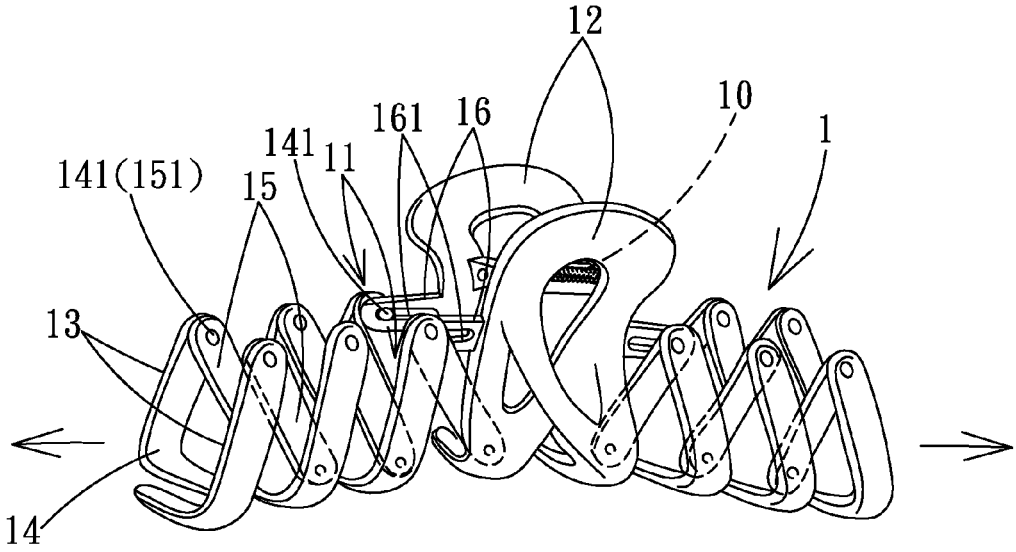
FIG. 1 shows a perspective view of a hair ornament of a first embodiment according to the preferred teachings of the present invention with the hair ornament in an extended state.
Figure 2:
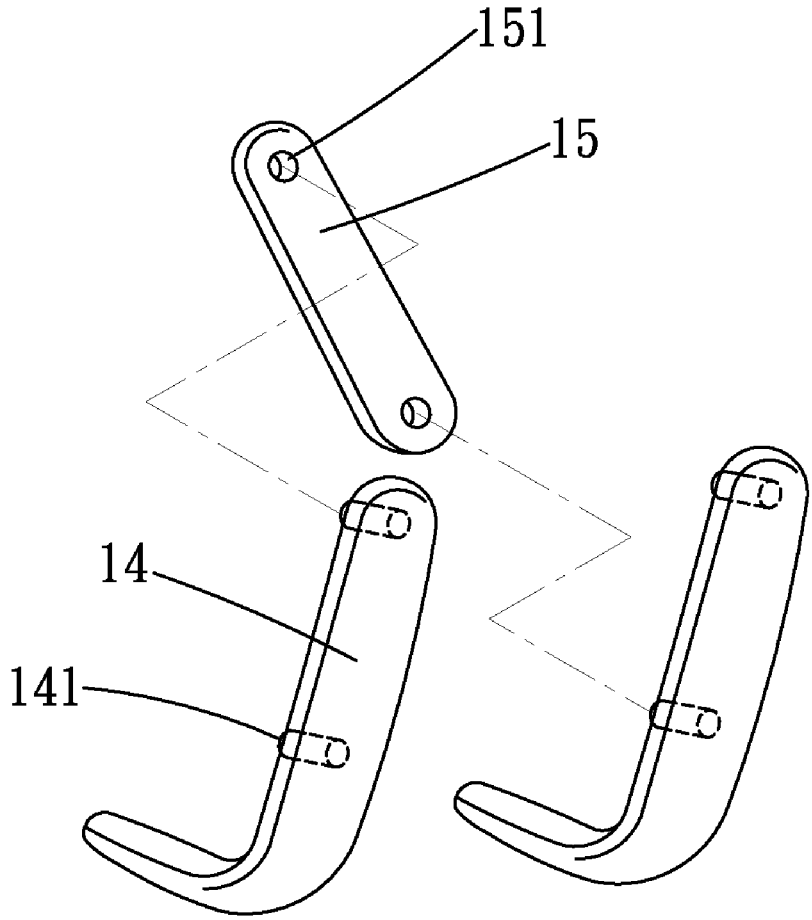
FIG. 2 shows an exploded, perspective view of a connecting member and two adjacent plates of the hair ornament of FIG. 1.
Figure 3:
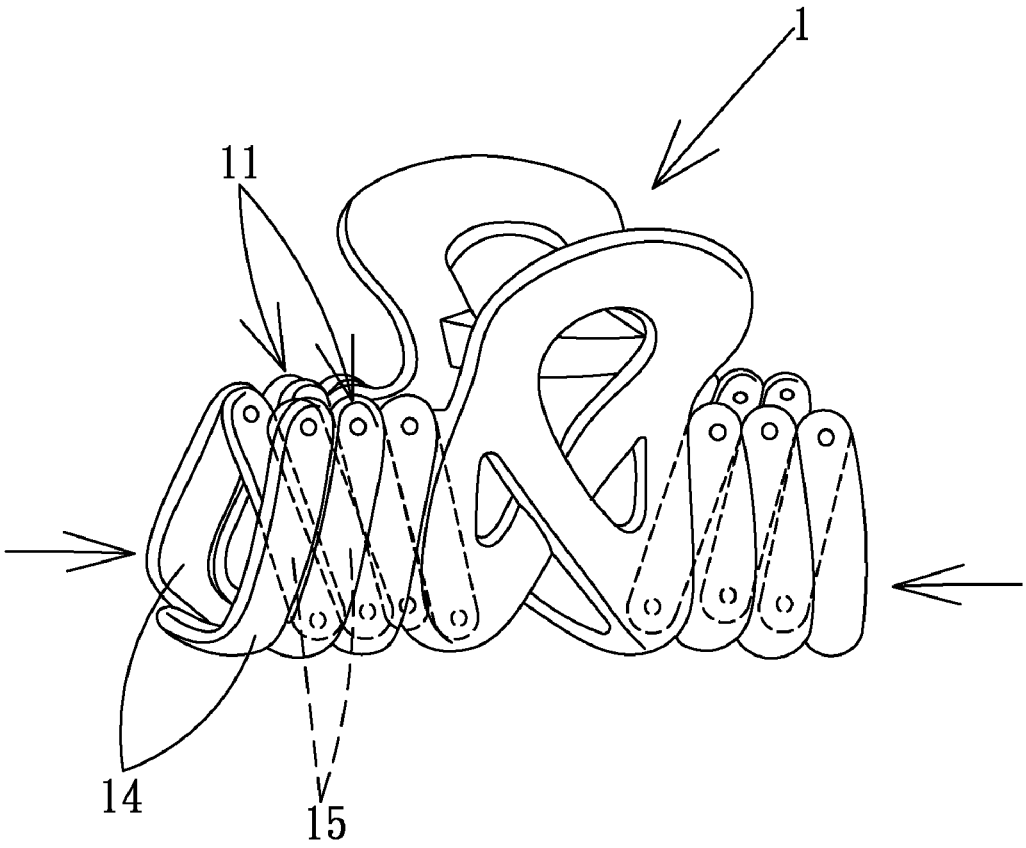
FIG. 3 shows a perspective view of the hair ornament of FIG. 1 in a collapsed state.
Figure 4:
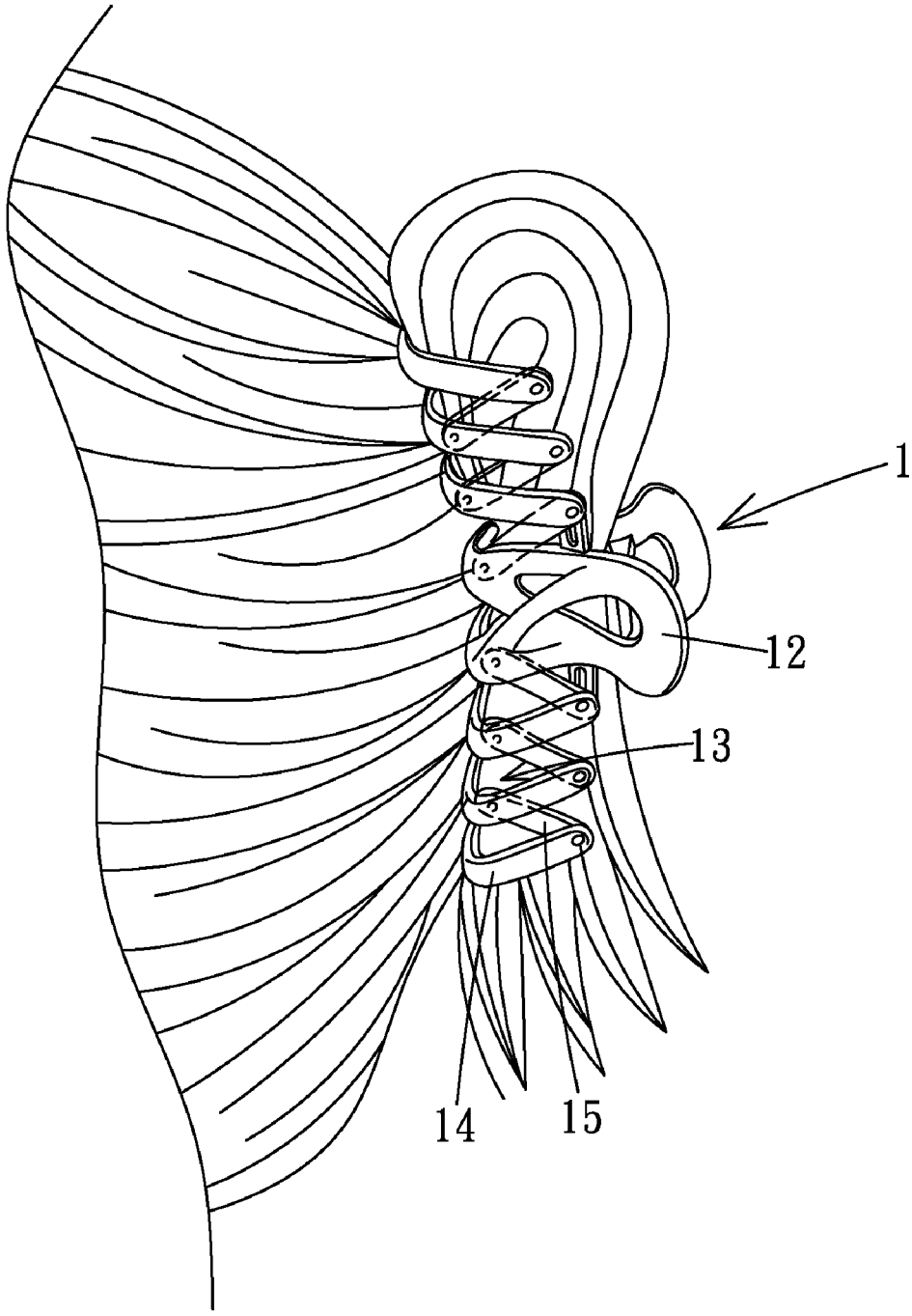
FIG. 4 shows a schematic perspective view illustrating use of the hair ornament of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

With reference to FIGS. 1-4, a hair ornament of a first embodiment according to the preferred teachings of the present invention includes a body 1 having two clamping portions 11 that are pivoted together. An elastic element 10 is mounted between the clamping portions 11. Each clamping portion 11 includes a pressing portion 12 on an end thereof. The clamping portions 11 can be opened and released by operating the pressing portions 12 to receive and clamp the hair of a user. Each clamping portion 11 includes an engagement section 13 for contact with the hair of the user. Each engagement section 13 includes a row of plates 14 arranged in a length direction of the body 1. Two adjacent plates 14 are connected by a connecting member 15. Each plate 14 includes first and second pivotal portions 141 in the form of pins. Each connecting member 15 includes a pivotal portion 151 in the form of a hole in each of two ends thereof. One of the pivotal portions 151 of each connecting member 15 is pivotably engaged with the first pivotal portion 141 of one of the two adjacent plates 14. The other pivotal portion 151 of each connecting member 15 is pivotably engaged with the second pivotal portion 141 of the other of the two adjacent plates 14. Thus, the spacing between each pair of plates 14 in the length direction of the body 1 can be increased (FIG. 1) or reduced (FIG. 3), adjusting the overall length of the engagement section 13. Thus, the extent of the engagement section 13 extending into the hair of the user can be adjusted. The pressing portions 12 are provided at centers of the clamping portions 11. An extension 16 extends from each of two opposite sides of each pressing portion 12 and includes a guide slot 161 extending in the length direction and slideably receiving one or more of the pivotal portions 141 in the form of pins. The guide slots 161 provide stable movement for the plates 14 while adjusting the spacing between the plates 14. Furthermore, the strength of the hair ornament in the extended position (FIG. 1) can be increased by the extensions 16. The hair ornament can easily be extended or collapsed to a desired extent according to differing head sizes and differing hair amounts of different users.

Figure 5:
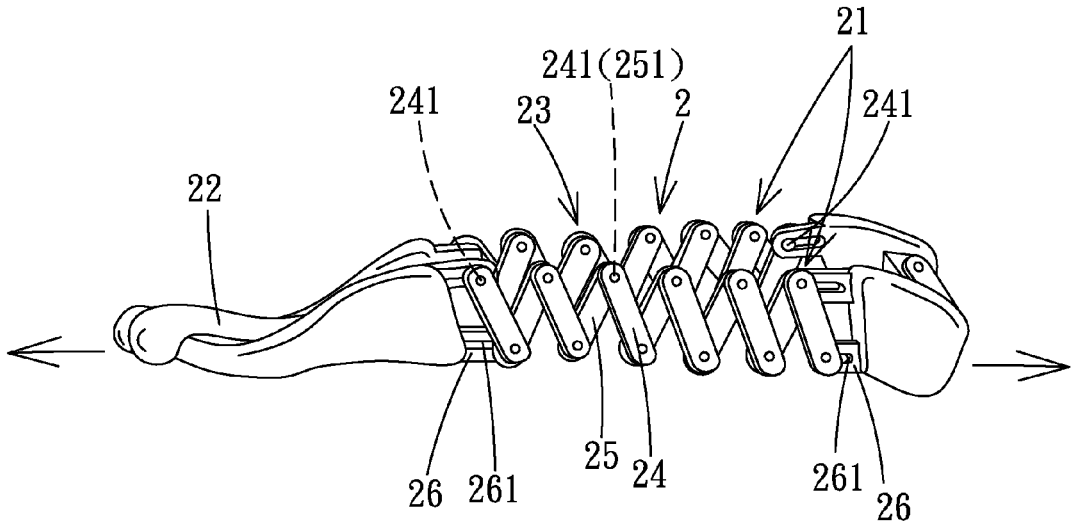
FIG. 5 shows a perspective view of a hair ornament of a second embodiment according to the preferred teachings of the present invention with the hair ornament in an extended state.
Figure 6:
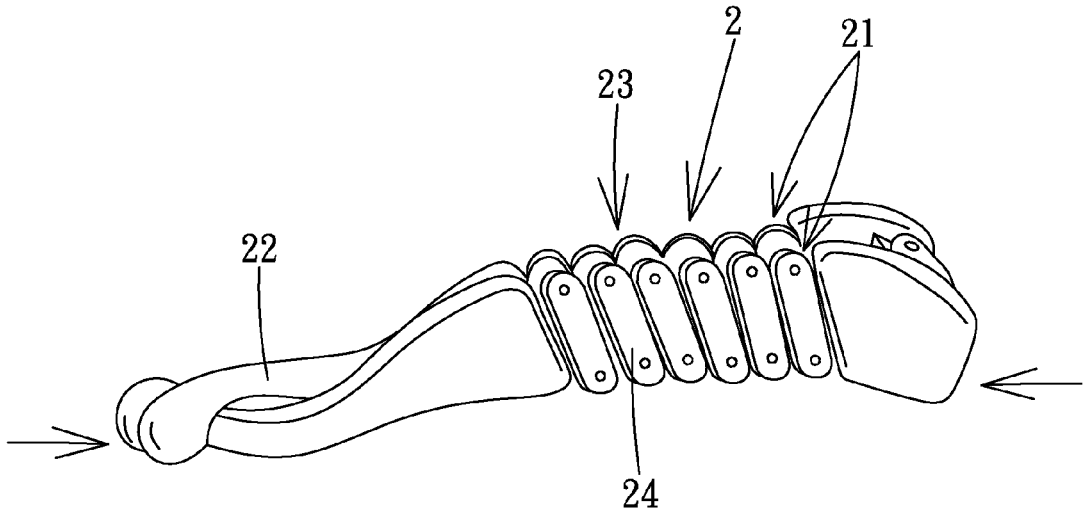
FIG. 6 shows a perspective view of the hair ornament of FIG. 5 in a collapsed state.
Figure 7:
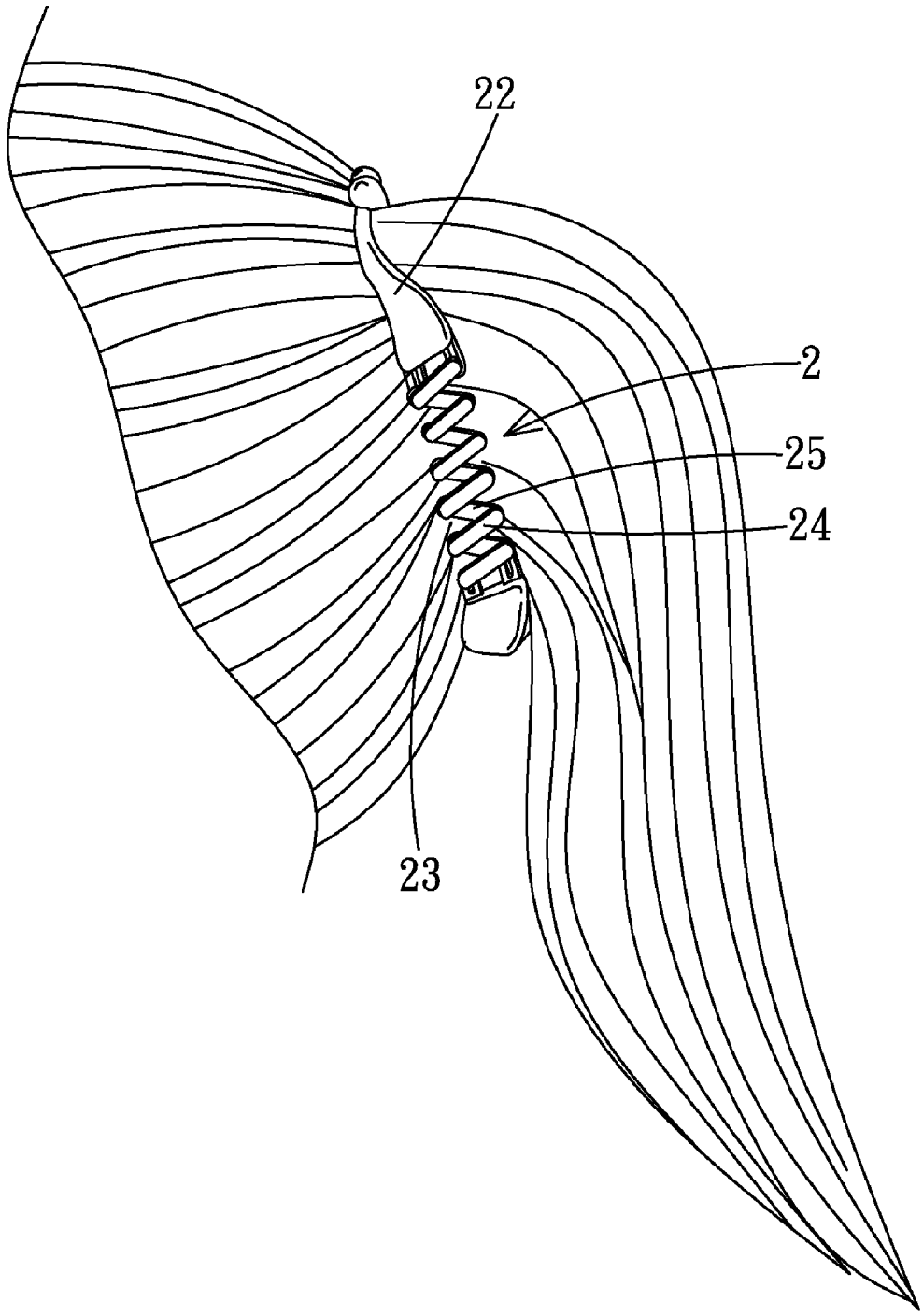
FIG. 7 shows a schematic perspective view illustrating use of the hair ornament of FIG. 5.

With reference to FIGS. 5-7, a hair ornament of a second embodiment according to the preferred teachings of the present invention includes a body 2 having two clamping portions 21. The clamping portions 21 are pivoted together at first ends thereof. Each clamping portion 21 includes an engaging portion 22 on a second end thereof. Each clamping portion 21 further includes an engagement section 23 intermediate the first and second ends for contact with the hair of the user. The clamping portions 21 can be opened to receive the hair of the user. The engaging portions 22 can be releasably engaged with each other such that the engagement sections 23 clamp the hair of the user. Each engagement section 23 includes a row of plates 24 arranged in a length direction of the body 2. Two adjacent plates 24 are connected by a connecting member 25. Similar to the first embodiment, each plate 24 includes first and second pivotal portions 241 in the form of pins. Each connecting member 25 includes a pivotal portion 251 in the form of a hole in each of two ends thereof. One of the pivotal portions 251 of each connecting member 25 is pivotably engaged with the first pivotal portion 241 of one of the two adjacent plates 24. The other pivotal portion 251 of each connecting member 25 is pivotably engaged with the second pivotal portion 241 of the other of the two adjacent plates 24. Thus, the spacing between each pair of plates 24 in the length direction of the body 2 can be increased (FIG. 5) or reduced (FIG. 6), adjusting the overall length of the engagement section 23. Thus, the extent of the engagement section 23 extending into the hair of the user can be adjusted. The first end of each clamping portion 21 includes first and second extensions 26 spaced in a direction perpendicular to the length direction. Each of the first and second extensions 26 has a guide slot 261 extending in the length direction and slideably receiving one or more of the pivotal portions 241 in the form of pins. Each engaging portion 22 has third and fourth extensions 26 spaced in the direction perpendicular to the length direction. One of the engagement sections 23 is mounted between the first and third extensions 26. The other engagement section 23 is mounted between the second and fourth extensions 26. Each of the third and fourth extensions 26 has a guide slot 261 extending in the length direction and slideably receiving one or more of the pivotal portions 241 in the form of pins. The guide slots 261 provide stable movement for the plates 24 while adjusting the spacing between the plates 24. Furthermore, the strength of the hair ornament in the extended position (FIG. 5) can be increased by the extensions 26. The hair ornament can easily be extended or collapsed to a desired extent according to differing head sizes and differing hair amounts of different users.

Figure 8:
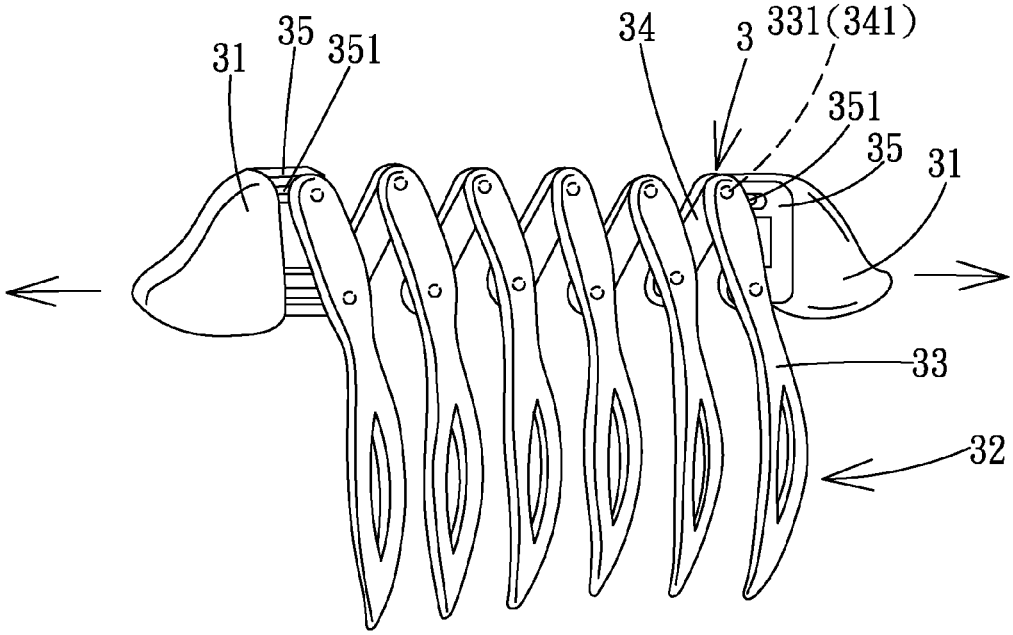
FIG. 8 shows a perspective view of a hair ornament of a third embodiment according to the preferred teachings of the present invention with the hair ornament in an extended state.
Figure 9:
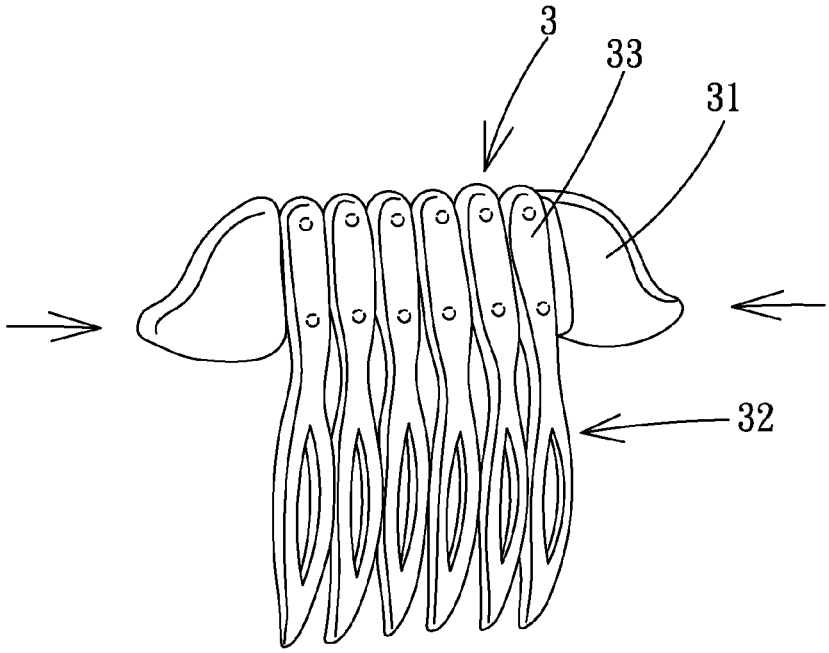
FIG. 9 shows a perspective view of the hair ornament of FIG. 8 in a collapsed state.
Figure 10:
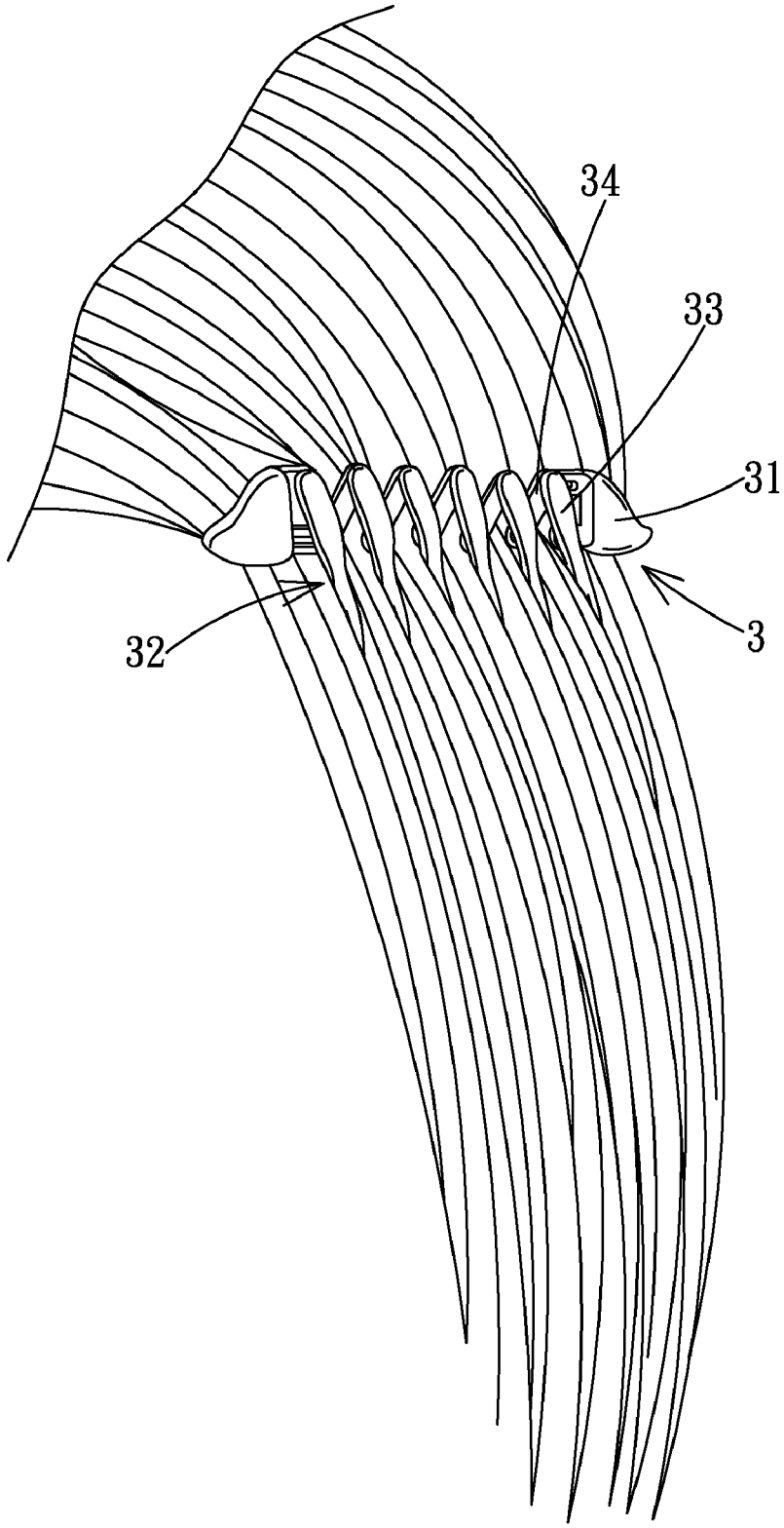
FIG. 10 shows a schematic perspective view illustrating use of the hair ornament of FIG. 8.

With reference to FIGS. 8-10, a hair ornament of a third embodiment according to the preferred teachings of the present invention includes a body 3 having two gripping portions 31 and an engagement section 32 intermediate the gripping portions 31. The engagement section 32 is adapted to extend through the hair of the user. Each engagement section 32 includes a row of plates 33 arranged in a length direction of the body 3. Two adjacent plates 33 are connected by a connecting member 34. Similar to the first embodiment, each plate 33 includes first and second pivotal portions 331 in the form of pins. Each connecting member 34 includes a pivotal portion 341 in the form of a hole in each of two ends thereof. One of the pivotal portions 341 of each connecting member 34 is pivotably engaged with the first pivotal portion 331 of one of the two adjacent plates 33. The other pivotal portion 341 of each connecting member 34 is pivotably engaged with the second pivotal portion 331 of the other of the two adjacent plates 33. Thus, the spacing between each pair of plates 33 in the length direction of the body 3 can be increased (FIG. 8) or reduced (FIG. 9), adjusting the overall length of the engagement section 32. Thus, the extent of the engagement section 32 extending into the hair of the user can be adjusted. Each of the gripping portions 31 includes first and second extensions 35 spaced in a direction perpendicular to the length direction. Each of the first and second extensions 35 has a guide slot 351 extending in the length direction and slideably receiving one or more of the pivotal portions 331 in the form of pins. The guide slots 351 provide stable movement for the plates 33 while adjusting the spacing between the plates 33. Furthermore, the strength of the hair ornament in the extended position (FIG. 8) can be increased by the extensions 35. The hair ornament can easily be extended or collapsed to a desired extent according to differing head sizes and differing hair amounts of different users.

Figure 11:
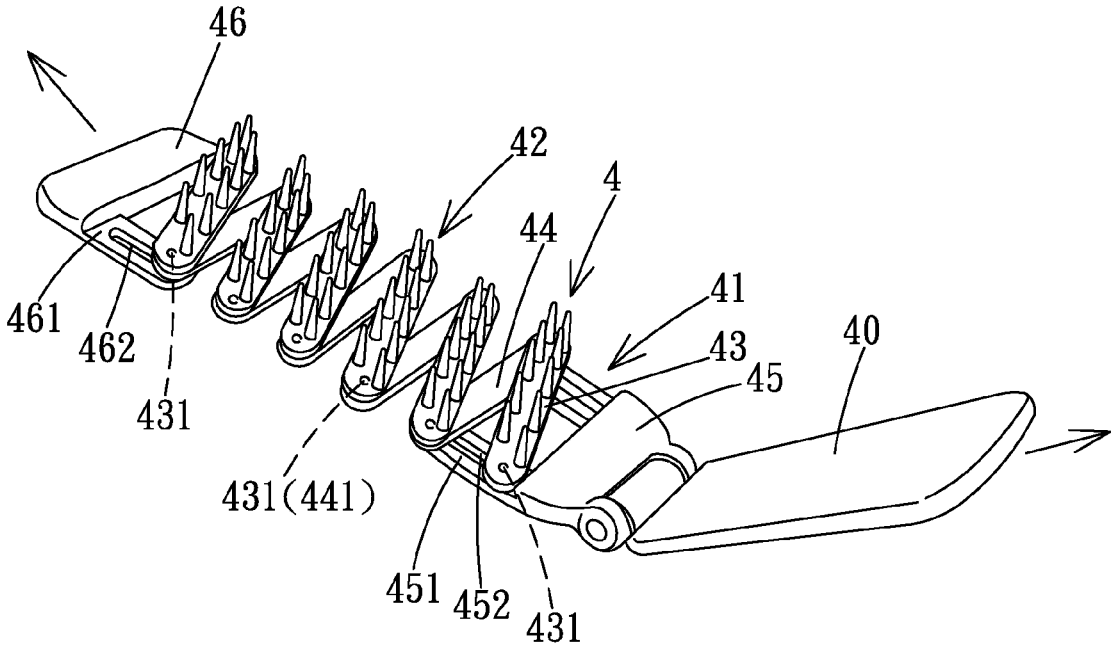
FIG. 11 shows a perspective view of a hair ornament of a fourth embodiment according to the preferred teachings of the present invention with the hair ornament in an extended state.
Figure 12:
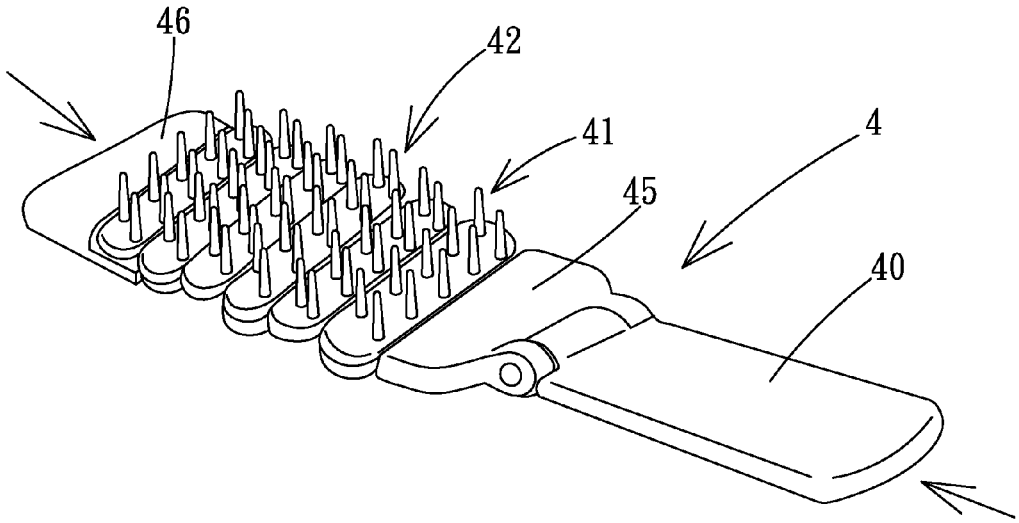
FIG. 12 shows a perspective view of the hair ornament of FIG. 11 in a collapsed state.
Figure 13:
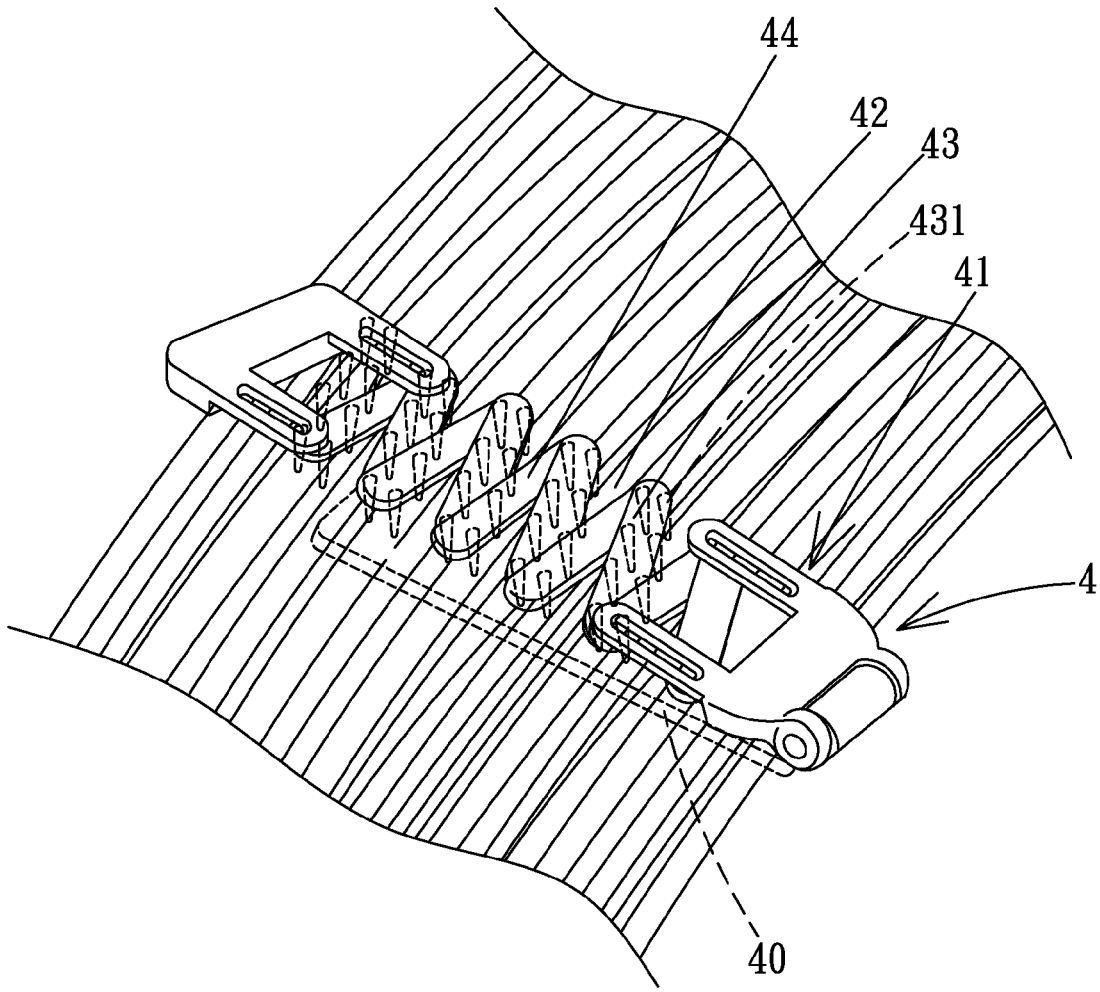
FIG. 13 shows a schematic perspective view illustrating use of the hair ornament of FIG. 12.
Figure 14:
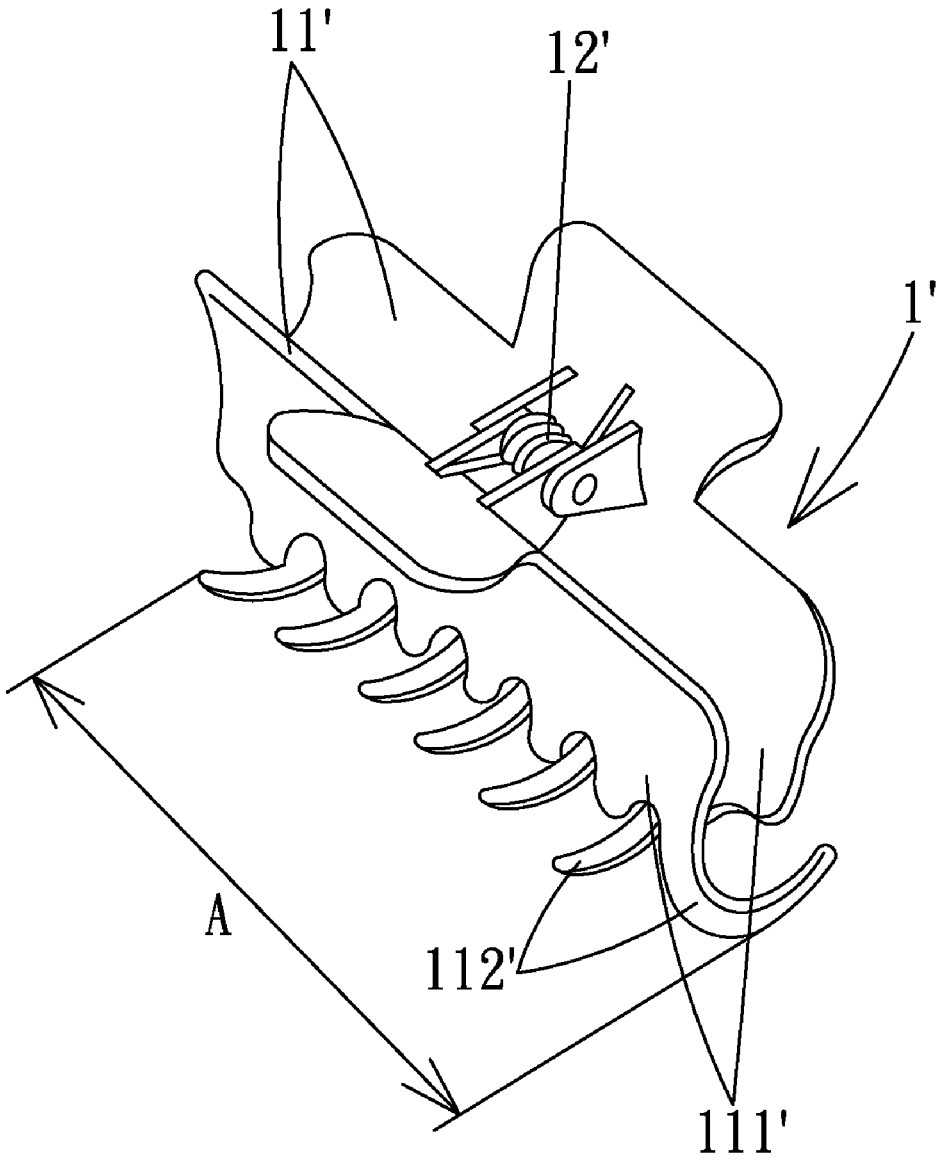
F I G .14 Prior Art
FIG. 14 shows a perspective view of a conventional hair ornament.

With reference to FIGS. 11-13, a hair ornament of a fourth embodiment according to the preferred teachings of the present invention includes a body 4 having two clamping plates 40 and 41 pivotably connected to each other. The clamping plates 40 and 41 can be opened to receive the hair of the user. The hair of the user is clamped by the clamping plates 40 and 41 when the clamping portions 40 and 41 are pivoted to a clamping position. The clamping plate 41 includes an engagement section 42 for contact with the hair of the user. The engagement section 42 includes a row of plates 43 arranged in a length direction of the body 4. Each plate 43 has a plurality of teeth 431 on a side thereof for extending into the hair of the user. Two adjacent plates 43 are connected by a connecting member 44. Similar to the first embodiment, each plate 43 includes first and second pivotal portions 431 in the form of pins. Each connecting member 44 includes a pivotal portion 441 in the form of a hole in each of two ends thereof. One of the pivotal portions 441 of each connecting member 44 is pivotably engaged with the first pivotal portion 431 of one of the two adjacent plates 43. The other pivotal portion 441 of each connecting member 44 is pivotably engaged with the second pivotal portion 431 of the other of the two adjacent plates 43. Thus, the spacing between each pair of plates 43 in the length direction of the body 4 can be increased (FIG. 11) or reduced (FIG. 12), adjusting the overall length of the engagement section 42. Thus, the extent of the engagement section 42 extending into the hair of the user can be adjusted. The clamping plate 41 includes first and second ends 45 and 46. The first end 45 of the clamping plate 41 is pivotably connected to the clamping plate 40. Each of the first and second ends 45 and 46 of the clamping plate 41 includes an extension 45, 46 having a guide slot 451, 461 extending in the length direction and slideably receiving one or more of the pivotal portions 431 in the form of pins. The guide slots 451 and 461 provide stable movement for the plates 43 while adjusting the spacing between the plates 43. Furthermore, the strength of the hair ornament in the extended position (FIG. 11) can be increased by the extensions 45 and 46. The hair ornament can easily be extended or collapsed to a desired extent according to differing head sizes and differing hair amounts of different users. It can be appreciated that the hair ornament of the fourth embodiment in the collapsed state can be utilized as a comb.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A hair ornament comprising a body including an engagement section adapted to be in contact with hair of a user, with the engagement section including a row of plates arranged along a length direction of the body, with two of the row of plates adjacent to each other being connected by a connecting member having first and second ends, with the first end of each of the connecting members pivotably connected to one of two adjacent plates, with the second end of each of the connecting members pivotably connected to another of the two adjacent plates, with a spacing between two adjacent plates being adjustable by pivoting the two adjacent plates to adjust an overall length of the body in the length direction of the body, with the body including first and second clamping portions that are pivoted together, with an elastic element mounted between the first and second clamping portions, with each of the first and second clamping portions including a pressing portion on an end thereof, with each of the first and second clamping portions including the engagement section, with each of the plates including first and second pivotal portions, with the first and second ends of each of the connecting members including third and fourth pivotal portions, with the first and second pivotal portions being one of a pin and a hole, with the third and fourth pivotal portions being another of the pin and the hole, with the third pivotal portion of each of the connecting members pivotably engaged with the first pivotal portion of one of two adjacent plates, with the fourth pivotal portion of each of the connecting members pivotably engaged with the second pivotal portion of the other of the two adjacent plates.

2. The hair ornament as claimed in claim 1, with the pressing portions provided at centers of the first and second clamping portions, with an extension extending from each of two opposite sides of each of the first and second pressing portions, with each of the extensions including a guide slot extending in the length direction and slideably receiving one of the first and second pivotal portions of at least one of the plates.

3. The hair ornament as claimed in claim 1, with the body including first and second clamping portions pivoted together at first ends thereof, with each of the first and second clamping portions including an engaging portion on a second end thereof, with each of the first and second clamping portions further including the engagement section intermediate the first and second ends, with the first and second clamping portions being openable to receive the hair of the user, with the engaging portions releasably engaged with each other such that the engagement section of each of the first and second clamping portions clamps the hair of the user, with each of the plates including first and second pivotal portions, with the first and second ends of each of the connecting members including third and fourth pivotal portions, with the first and second pivotal portions being one of a pin and a hole, with the third and fourth pivotal portions being another of the pin and the hole, with the third pivotal portion of each of the connecting members pivotably engaged with the first pivotal portion of one of two adjacent plates, with the fourth pivotal portion of each of the connecting members pivotably engaged with the second pivotal portion of the other of the two adjacent plates, with the first end of each of the first and second clamping portions including first and second extensions spaced in a direction perpendicular to the length direction, with each of the engaging portions including third and fourth extensions spaced in the direction perpendicular to the length direction, with the engagement section of the first clamping portion mounted between the first and third extensions, with the engagement section of the second clamping portion mounted between the second and fourth extensions, with each of the first, second, third, and fourth extensions including a guide slot extending in the length direction, with the guide slot of each of the first, second, third, and fourth extensions slideably receiving one of the first and second pivotal portions of at least one of the plates.

4. The hair ornament as claimed in claim 1, with the body including first and second gripping portions, with the engagement section intermediate the first and second gripping portions, with each of the plates including first and second pivotal portions, with the first and second ends of each of the connecting members including third and fourth pivotal portions, with the first and second pivotal portions being one of a pin and a hole, with the third and fourth pivotal portions being another of the pin and the hole, with the third pivotal portion of each of the connecting members pivotably engaged with the first pivotal portion of one of two adjacent plates, with the fourth pivotal portion of each of the connecting members pivotably engaged with the second pivotal portion of the other of the two adjacent plates.

5. The hair ornament as claimed in claim 4, with each of the first and second gripping portions including first and second extensions spaced in a direction perpendicular to the length direction, with each of the first and second extensions including a guide slot extending in the length direction and slideably receiving one of the first and second pivotal portions of at least one of the plates.

6. The hair ornament as claimed in claim 1, with the body including first and second two clamping plates pivotably connected to each other, with the first and second clamping plates being openable to receive the hair of the user, with the hair of the user being clamped by the first and second clamping plates when the first and second clamping portions are pivoted to a clamping position, with the second clamping plate including the engagement section, with each of the plates including first and second pivotal portions, with the first and second ends of each of the connecting members including third and fourth pivotal portions, with the first and second pivotal portions being one of a pin and a hole, with the third and fourth pivotal portions being another of the pin and the hole, with the third pivotal portion of each of the connecting members pivotably engaged with the first pivotal portion of one of two adjacent plates, with the fourth pivotal portion of each of the connecting members pivotably engaged with the second pivotal portion of the other of the two adjacent plates, with the second clamping plate including first and second ends, with the first end of the second clamping plate pivotably connected to the first clamping plate, with each of the first and second ends of the second clamping plate including an extension having a guide slot, with each of the guide slots extending in the length direction and slideably receiving one of the first and second pivotal portions of at least one of the plates.

* * * * *